US007364520B2

(12) United States Patent
Chauvin et al.

(10) Patent No.: US 7,364,520 B2
(45) Date of Patent: Apr. 29, 2008

(54) SPORTING GOOD ITEMS INCLUDING PRE-PRINTED GRAPHICS

(75) Inventors: Dewey Chauvin, Simi Valley, CA (US); Danny Tolentino, Los Angeles, CA (US); Peter Yan, Arcadia, CA (US); Ian Montgomery, Simi Valley, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 11/537,437

(22) Filed: Sep. 29, 2006

(65) Prior Publication Data

US 2008/0081711 A1 Apr. 3, 2008

(51) Int. Cl.

| | |
|---|---|
| ***A63B 59/06*** | (2006.01) |
| ***A63B 59/14*** | (2006.01) |
| ***A63B 49/00*** | (2006.01) |
| ***F42B 6/04*** | (2006.01) |

(52) U.S. Cl. ..... 473/566; 473/567; 473/560; 473/516; 473/578; 473/564; 280/200

(58) Field of Classification Search ..... 473/457, 473/519, 520, 560–568, 516, 578; 280/200
See application file for complete search history.

(56) References Cited

U.S. PATENT DOCUMENTS

| | | | | |
|---|---|---|---|---|
| 4,021,285 | A | | 5/1977 | Amberg |
| 4,021,286 | A | | 5/1977 | Amberg |
| 4,025,381 | A | | 5/1977 | Amberg |
| 4,035,222 | A | | 7/1977 | Amberg |
| 4,076,786 | A | | 2/1978 | Amberg |
| 4,102,728 | A | | 7/1978 | Smith |
| 4,111,738 | A | | 9/1978 | Amberg |
| 4,138,026 | A | | 2/1979 | Conklin |
| 4,187,276 | A | | 2/1980 | Amberg |
| 4,219,124 | A | | 8/1980 | Amberg |
| 4,241,115 | A | * | 12/1980 | Temin ..... 428/336 |
| 4,243,466 | A | | 1/1981 | Linder |
| 4,412,876 | A | | 11/1983 | Lerner et al. |
| 4,644,630 | A | * | 2/1987 | Blum ..... 29/453 |
| 4,761,200 | A | | 8/1988 | Szeremeta |
| 4,781,785 | A | | 11/1988 | Szeremeta |
| 5,390,477 | A | | 2/1995 | Sowden |
| 5,422,152 | A | | 6/1995 | Langeland et al. |
| 5,475,969 | A | | 12/1995 | Sowden |
| 5,558,326 | A | * | 9/1996 | Adamson et al. ..... 473/563 |
| 5,628,847 | A | | 5/1997 | Sowden |
| 5,737,900 | A | | 4/1998 | Konstantin et al. |
| 5,775,019 | A | | 7/1998 | Johnson |
| 5,820,438 | A | * | 10/1998 | Horton, III ..... 446/213 |

(Continued)

*Primary Examiner*—Mark S Graham
(74) *Attorney, Agent, or Firm*—Perkins Coie LLP

(57) ABSTRACT

A sporting good item or other product includes a "shrink-label" formed from a shrink-sleeve, shrink-wrap, or a stretch-sleeve adhered to or otherwise affixed to an outer surface of the item. The shrink-label includes pre-printed graphics and closely conforms to the item's outer surface, including any contours or tapered regions, so that the graphics may be displayed anywhere on the item. The shrink-label may optionally be applied to the item via an automated device. A clear coat or other protective layer may optionally be applied to an outer surface of the shrink-label to increase its durability and resistance to abrasion, which is particularly beneficial when the shrink-label is applied to an item intended for impact applications, such as a ball bat.

13 Claims, 2 Drawing Sheets

U.S. PATENT DOCUMENTS 5,831,641 A * 11/1998 Carlson ..... 347/2
5,833,115 A 11/1998 Eiten
5,957,279 A 9/1999 Howes
5,962,368 A * 10/1999 Poole ..... 503/227
6,129,959 A 10/2000 Mercer et al.
6,162,158 A 12/2000 Mercer et al.
6,263,940 B1 7/2001 Menayan
6,282,353 B1 8/2001 Clark
6,287,221 B1 * 9/2001 Pino ..... 473/564
6,420,309 B1 * 7/2002 Grime et al. ..... 503/227
6,523,328 B1 2/2003 DeCardenas et al.
6,543,514 B2 4/2003 Menayan
6,786,515 B2 9/2004 Franko, Sr.
2004/0166970 A1 * 8/2004 Sutherland ..... 473/567
2006/0207493 A1 * 9/2006 Chasmar ..... 116/173
2007/0044351 A1 * 3/2007 Currie ..... 40/1

* cited by examiner

SPORTING GOOD ITEMS INCLUDING PRE-PRINTED GRAPHICS

BACKGROUND

Current methods of applying graphics to sporting good items are typically very labor intensive and, as a result, relatively costly. Silk-screening, for example, is a method prevalently used to apply graphics to a multitude of sporting good items, such as ball bats, hockey shafts, and so forth. Silk-screening requires an operator to separately apply each color of ink or paint used to label the item or product. Many products may include two or more colors, while several high-end products may include 3 or more colors. To provide high quality graphics, precise aligning and registering of each color image is required. Registration of each color image is particularly challenging and generally increases product costs, not only because of the difficult labor required to properly register the color images but also due to reduced acceptable yields. Thus, the process of labeling a sporting good item can be very labor intensive, inefficient, and expensive.

An additional complication arises when applying graphics to tapered or contoured products, such as ball bats having varying diameters. The change in diameter of tapered products makes it extremely difficult to maintain image clarity and to align and register multiple images. The use of silk-screening on highly tapered products, such as ball bats, generally limits the effective size of a logo or other graphics to a narrow range of diameters, since the image otherwise skids or slips at the lower end or upper end of the taper. In general, the diameter of the largest section of a silk-screen graphic cannot vary by more than 5 to 7% from the diameter of the smallest section of the graphic before the graphic image becomes distorted. The percentage difference between the largest diameter (approximately 2.25") and the smallest diameter (approximately 0.81") of a typical softball bat, however, is approximately 64%. For typical baseball bats, this percentage is approximately 68% (difference between an approximately 0.88" handle and an approximately 2.75" barrel). This dramatic difference in diameters greatly limits the potential effective length of a shrink-wrap graphic on a ball bat or other tapered product.

To overcome some of the shortcomings associated with silk-screening graphics onto sporting good items, decals have been increasingly used to apply these types of graphics. Decals cost-effectively increase the resolution, number of colors, and, in many cases, the possible length of the graphics as compared to traditional silk-screening methods. The decals are typically made using medium to high volume printing methods (e.g., flexor, gravure, digital printing, or even silk-screening for lower production volumes), which increase the potential for lower cost and higher quality graphics.

On highly contoured or highly tapered products, such as ball bats, manual labor is typically required to apply decal labels, since automated application equipment has not proven to be effective at applying decals to highly contoured products. This increased manual labor somewhat offsets the cost savings associated with using decals instead of silk-screening applications, particularly since decals applied to impact items generally require additional protection from abrasion and chipping. This additional protection is typically provided by a durable clear coat, such as a coating of polyurethane, applied to an outer surface of the decal. Nonetheless, the use of decals typically reduces the cost of applying graphic labels to sporting good items by approximately 25 to 40% of the cost associated with applying graphics via traditional silk-screening methods.

FIG. 1 illustrates a ball bat 10 including a typical decal 12 applied to an outer surface of the body of the ball bat 10 via a layer of paint 14. A layer of clear coat 16 is applied to an outer surface of the decal 12. The decal 12 terminates at an end portion 18 such that it covers only a portion of the tapered region 20 of the ball bat 10. The decal 12 does not extend to the handle region 22 of the ball bat 10. Applying decals in such a manner is common since it is typically difficult to effectively apply decals over a substantial portion of the highly contoured or tapered portions of the ball bat 10.

While the use of decals provides cost savings relative to traditional silk-screening methods, decals still have shortcomings. For instance, decals are not particularly durable, and manual labor is typically required to apply decals to irregularly shaped items, such as ball bats. Moreover, due to the contours or tapers present in these irregularly shaped items, decals typically cannot be effectively applied substantially over the entire length of the items. Thus, a need exists for improved methods for applying graphics or labels to sporting good items or other impact items in an efficient, cost-effective manner.

SUMMARY

A sporting good item or other item includes a "shrink-label" formed from a shrink-sleeve, shrink-wrap, or a stretch-sleeve adhered to or otherwise affixed to an outer surface of the item. The shrink-label includes pre-printed graphics and closely conforms to the item's outer surface, including any contours or tapered regions, so that the graphics may be displayed anywhere on the item. The shrink-label may optionally be applied to the item via an automated device. A clear coat or other protective layer may optionally be applied to an outer surface of the shrink-label to increase its durability and resistance to abrasion, which is particularly beneficial when the shrink-label is applied to an item intended for impact applications, such as a ball bat. Methods of applying a shrink-label to a sporting good item or other product are also described.

Other features and advantages will appear hereinafter. The features described above can be used separately or together, or in various combinations of one or more of them. Sub-combinations of the features described are also contemplated. Many of the method steps described herein may be performed in a different order than that which is explicitly described.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below. Any terminology intended to be interpreted in any restricted manner, however, will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Shrink-sleeves, shrink-wrap, or stretch-sleeves, collectively referred to herein as "shrink-labels," typically grace cans, bottles, compact disc cases, jars, and so forth to attract consumers to products as diverse as baby food, air fresheners, coffee, and shaving cream. A shrink-label is typically a film label printed on an oriented plastic sheet or tube. When heat is applied to the shrink-label it conforms to the contour of the item that it surrounds. A shrink-label is typically manufactured from a thin, pre-printed, thermo-retractable plastic film, which is formed into a tube and then wound onto a core. The roll of tubing is then unwound and cut to length. Each cut piece is placed on or around the item to which the label is to be shrunk. Heat is applied to the shrink-label, causing the shrink-label to conform to the shape of the item over which it has been placed. While shrink-labels have been effectively used on relatively small, non-impact items, they have not been implemented on larger items intended for impact implications, such as sporting good items.

Figure 1:
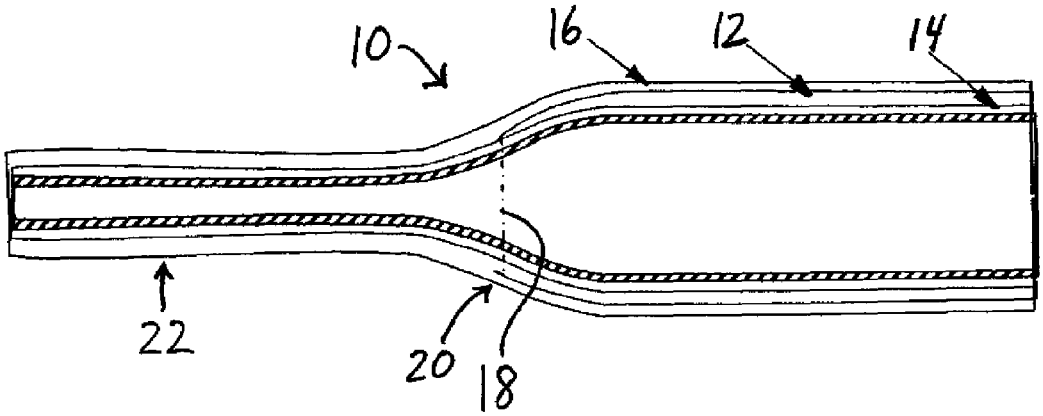
Fig. 1 Prior Art
FIG. 1 is a partial side-sectional view of a ball bat including a decal applied to an outer surface thereof, according to a prior art method.
Figure 2:
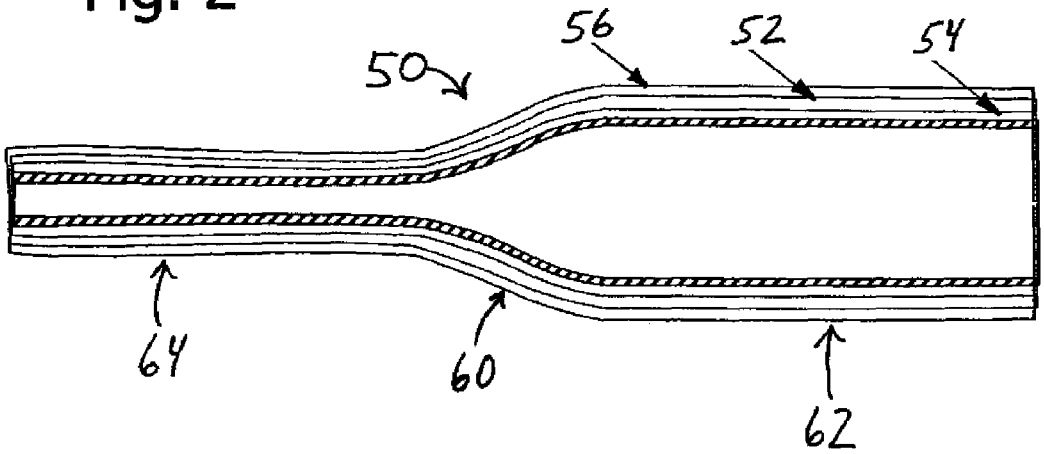
FIG. 2 is a partial side-sectional view of a ball bat including a shrink-label applied to an outer surface thereof, according to one embodiment.

Referring to FIG. 2, according to one embodiment, a ball bat 50 includes a shrink-label 52 adhered to an outer surface of the ball bat 50 via an adhesive layer 54. The ball bat 50 may be made of aluminum, titanium, composite material, or any other suitable materials. While a ball bat 50 is shown in FIG. 2, the concepts described herein may be applied to other sporting good items or other items, particularly but not limited to items intended for impact applications, such as hockey sticks, archery arrows, tennis racquets, bicycle frames, and so forth.

To achieve sufficient adhesion of the shrink-material to an impact sporting good item, such as the ball bat 50, a high strength, high toughness adhesive material, such as ethylene acrylic acid copolymer (EAA), polyurethane, acrylic, epoxy, or a similar structural adhesive, is preferably used to form the adhesive layer 54. Surprisingly, an adhesive layer 54 of paint, such as a tack free, heat curable paint, provides an exceptional bond between the ball bat 50 and the shrink-label 52. Use of a high strength, high toughness polymeric paint, for example, has been found to offer exceptional bond strength. Any other suitable adhesive material may alternatively be used. The adhesive layer 54 may have a thickness of approximately 1 to 5 mm, or approximately 3 mm, or may have any other suitable thickness. Double-sided tape may alternatively be used for adhering the shrink-label 52 to the ball bat 50, but it is typically more difficult to achieve a smooth finish on a tapered or contoured item when tape is used as the bonding material.

A layer of clear coat 56, such as a coating of polyurethane, epoxy, vinyl, a polymeric material, or a similar paint or powder coat or other abrasion-resistant coating, may optionally be applied to an outer surface of the shrink label 52 to increase the durability of the shrink label 52. Including a layer of clear coat 56 can greatly increase the abrasion resistance of the shrink-label 52, and therefore may be particularly desirable for high-end ball bats and other high-end items intended for impact applications.

The shrink-label material may be made from one or more of a variety of films or similar materials such as poly-vinyl chloride (PVC), polyolefin (POF), glycol-modified polyethylene terephthalate (PET-G), oriented polystyrene shrink-film (OPSOPS), or any other suitable "shrink" material. PVC material, for example, is generally cost-effective and is relatively easy to control during the shrink process. PVC is also generally available in grades that work well in steam applications. PVC provides relatively moderate scuff resistance, however, and it may therefore be beneficial to include a strong, abrasion-resistant clear coat when PVC is applied as labeling on an impact item. OPS shrink-material is typically relatively inexpensive and also has a relatively low vertical shrink rate. Thus, OPS labeling generally provides a very consistent finish. PET provides exceptional scuff resistance and a high percentage of shrink. PET films, therefore, may be a preferred material for items intended for high abrasion applications, particularly if a clear coat is not included to provide additional abrasion resistance.

The shrink-label 52 may be located over any portion or portions of the ball bat 50. The shrink-material's ability to readily mate with and conform to nearly any contour, while leaving an attractive finish, greatly simplifies the application of graphics to irregularly shaped products, such as ball bats including a tapered or contoured body. Shrink-labeling provides the opportunity to place graphics over the entire length of such a product, from the knob to the cap of a tapered or contoured ball bat, for example. Indeed, a shrink-label 52 may be applied to a ball bat 50 having a diameter change of 68% (the approximate diameter change of a typical baseball bat) without distortion of the label graphics. Thus, the shrink-label 52 may be positioned over the contours of the barrel 62, the handle 64, and the tapered region 60 of the ball bat 50, and may optionally be located over substantially the entire length of the ball bat 50, without graphic distortion.

The labeling, which may include letters, numbers, colors, or other graphics, of the shrink-label 52 may include one or more inks, dyes, paints, or other suitable substances applied to an inner surface of the plastic film (or other suitable material) of the shrink-label 52. In one embodiment, one or more sublimation inks, such as a polyester-based paint, may be used to provide the labeling on the shrink label 52. When such a shrink-label 52 is applied to the outer surface of the ball bat 50, the sublimation ink transfers from the shrink-label 52 into the adhesive layer 54 on the bat surface, such that the labeling remains on the bat even if the film material of the shrink-label 52 is chipped away or otherwise removed from the ball bat 50.

Sublimation is a method of transferring an image using an ink, for example, that sublimates, i.e., jumps from one phase to another. In the case of sublimation inks, the ink becomes a gas during the curing process and leaves the transfer medium (i.e., the shrink-film) and transfers to an adjacent surface (i.e., the paint or adhesive layer 54 on the ball bat 50). Sublimation is a common technique used for printing pictures or images on coffee mugs, tee shirts, trophies, and so forth. To effectively transfer the image, the shrink-film is held in intimate contact with the adhesive layer 54 on the bat surface where the image is to be "deposited." For best color saturation and image quality (e.g., depth of hue and resolution), a white polyester-based paint may be used as the receiving material for the sublimation ink.

The shrink-labeling process can take advantage of high-volume printing methods, similar to those used for printing decals, and may utilize a relatively low-cost, automated process for applying the shrink-labels to sporting good items or other impact items. Additionally, low cost printing methods may be used to apply the graphics to the shrink-film when the film is in a flat form. This is highly advantageous for producing high quality images. The shrink-film's ability to shrink and conform to the contours of a product facilitates easy application of the graphics, particularly to irregularly shaped packages.

Figure 3:
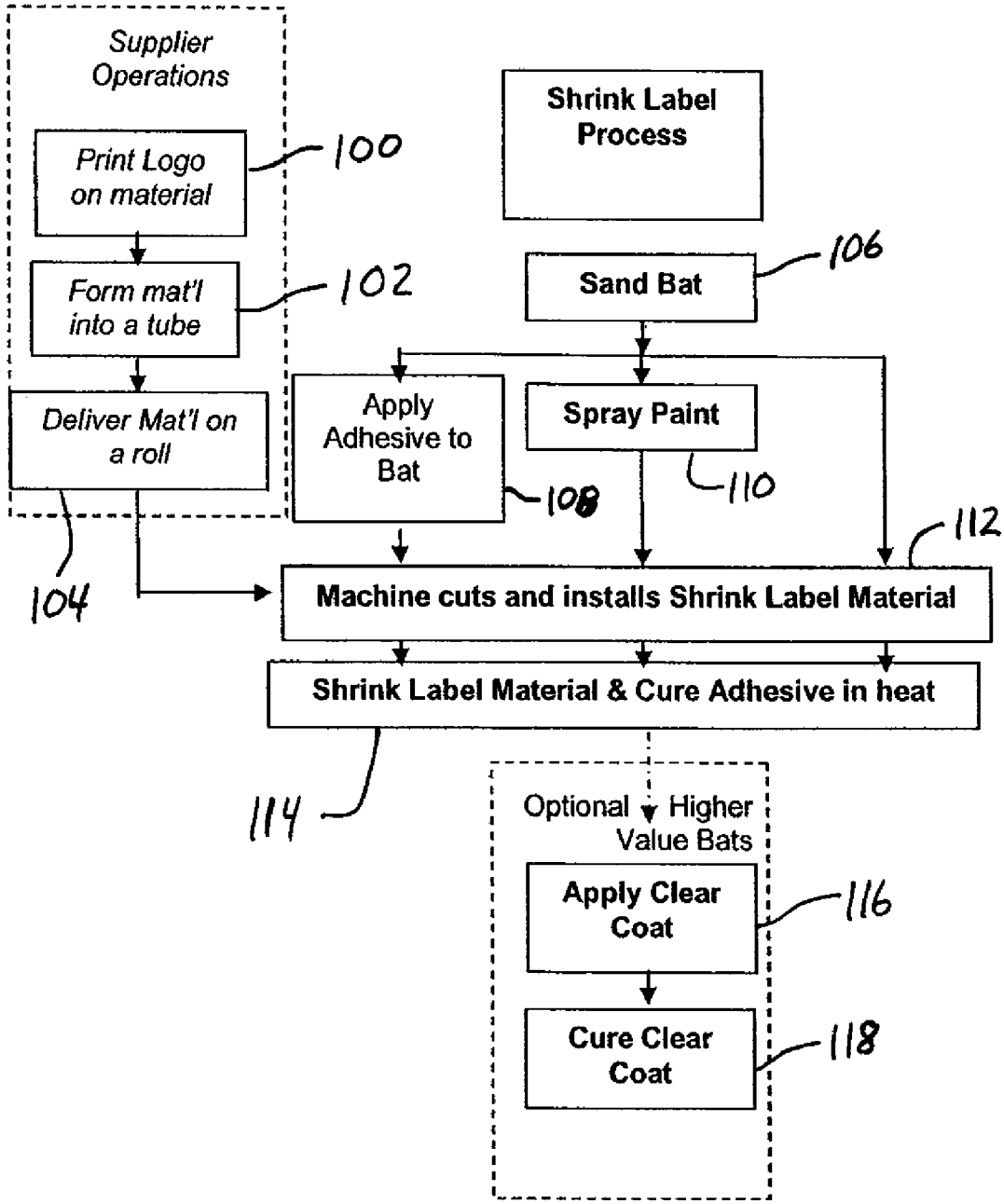
FIG. 3 is a flowchart including steps for applying a shrink-label to a ball bat, according to one embodiment.

FIG. 3 illustrates a process for creating a shrink-label and applying the shrink-label to a ball bat, according to one embodiment. Any of the following steps may be performed manually but most or all of the steps are preferably automated to increase efficiency and throughput. At step 100, a shrink-label supplier prints a logo or other graphics onto a sheet of shrink-material. Standard ink, dye, paint, sublimation ink, or any other suitable material may be used to create the graphics. At step 102, the sheet of shrink-material is formed into a tube. The tube of labeled shrink-material is then delivered to the ball bat manufacturer, at step 104. The above steps may alternatively be performed by the ball bat manufacturer itself.

At the ball bat manufacturers facilities the outer surface of the ball bat is preferably sanded, at step 106, before application of the shrink label. A layer of adhesive is applied to the ball bat, at step 108. If paint is used as all or part of the adhesive layer, the paint may be sprayed onto the ball bat, at step 110 (i.e., step 110 is optional and may replace or be a subset of step 108). As described above, a layer of tack free, heat curable paint provides an exceptional adhesive bonding layer.

The roll of shrink material is loaded into a machine that cuts the shrink material to the desired size and blows or otherwise installs the shrink material onto the ball bat, at step 112. The ball bat is then moved into a heat tunnel, or other heating apparatus, which applies heat to shrink the label material to mate with the contours of the ball bat and to cure the adhesive layer, at step 114. For ball bats requiring increased abrasion resistance, a layer of clear coat may optionally be applied to the outer surface of the shrink label, at step 116. The clear coat is cured via a heating process, at step 118. The clear coat may be cured during the shrink-label curing process (i.e., step 114 may coincide with step 118), or may be cured during a separate subsequent curing process.

Other steps may optionally be performed to increase the durability or adhesion of the shrink-label. In one embodiment, a corona discharge treatment of the shrink-film may be performed prior to applying ink to the film to sufficiently increase bond strength, which promotes the ink being present in the adhesive layer. Utilizing this method may reduce the need for a clear coat, since the graphics will remain on the ball bat even if a portion of the shrink-film is chipped away from the ball bat. In another embodiment, the ink may be added above the film's bond layer, in which case a highly durable clear coat should be used to protect the ink from abrasion.

While shrink-labels have long been applied to consumer products and other non-impact items, it has not been contemplated that shrink-labels could effectively hold up on items intended and designed for impact applications. Indeed, shrink-labeling on typical consumer products does not require near the level of adhesion or durability that shrink-labeling on ball bats and other impact items demands. For sporting good applications, the shrink-label generally needs to be tough, extremely abrasion resistant, and strongly adherent. During normal use, any type of bat graphic will undergo some degree of nicking or chipping. Increased label toughness can delay or reduce nicking or chipping of the label. If complete peeling failure of the label occurs, however, the product could be rendered unusable or unfit for competitive play. Thus, strong adhesion of the label to the item is a key requirement for impact applications. Such a level of adhesion has not been required for consumer products and other non-impact items.

Unexpectedly, shrink labels applied to items intended for impact implications exhibit surprisingly high durability and abrasion resistance. Indeed, when taber abrasion tests were performed on ball bats including a variety of shrink labels and decal labels, the abrasion resistance of the shrink labels compared favorably to that of the decal labels (and to that of labels painted onto the outer surface of the ball bat). This abrasion resistance further increased when a layer of clear coat was applied to the outer surface of the shrink-labels.

Some sample durability/abrasion resistance testing numbers are as follows (wherein durability is measured by the number of strokes of a load block against the label required to cause appreciable abrasion):

| | |
|---|---|
| Epoxy ink/paint on surface of bat | 1,500-2,500 strokes |
| Decals (without clear coat) | 100-1,500 strokes |
| Decals with clear coat | 1,500-10,000 strokes |
| PET shrink wrap only | 5,000-7,500 strokes |
| PVC shrink wrap only | 3,000-6,000 strokes |
| Shrink wrap with clear coat | 10,000-15,000 strokes |

Even better results likely could be achieved using a hard clear coat that is curable at a temperature not higher than that used to shrink the label and to cure the adhesive layer.

During testing, shrink-labels also exhibited very good resistance to chipping and peeling, particularly when a suitable adhesive was used to secure the shrink-labels to their respective ball bats or other impact items. As with abrasion resistance, resistance to chipping and peeling increases when a layer of clear coat is applied to an outer surface of the shrink label.

While several embodiments have been shown and described, various changes and substitutions may of course be made, without departing from the spirit and scope of the invention. Many of the method steps described herein, for example, may be performed in a different order than that which is explicitly described. The invention, therefore, should not be limited, except by any claims and their equivalents.

What is claimed is:

1. A sporting good item, comprising:

a contoured body designed for impact applications; and a shrink-label, including graphics, adhered to an outer surface of the contoured body via a tack free, heat curable paint.

2. The sporting good item of claim 1 wherein the sporting good item comprises a ball bat including a tapered region to which at least a portion of the shrink-label is adhered.

3. The sporting good item of claim 2 wherein the shrink-label is adhered to substantially the entire length of the ball bat.

4. The sporting good item of claim 1 further comprising a layer of abrasion-resistant coating on an outer surface of the shrink-label.

5. The sporting good item of claim 4 wherein the abrasion-resistant coating comprises a layer of clear coat selected from the group consisting of polyurethane, epoxy, vinyl, and a polymeric material.

6. The sporting good item of claim 1 wherein the graphics comprise a sublimation ink.

7. The sporting good item of claim 1 wherein the sporting good item comprises one of a hockey stick, an archery arrow, a tennis racquet, and a bicycle frame.

8. The sporting good item of claim 1 wherein the shrink-label comprises a shrink-sleeve.

9. A ball bat, comprising:

a handle;

a barrel;

a tapered region joining the handle to the barrel;

a shrink-label, including graphics, adhered to an outer surface of the tapered region and to at least one of an outer surface of the barrel and an outer surface of the handle via a tack free, heat curable paint.

10. The ball bat of claim 9 wherein the shrink-label is adhered to the handle, the tapered region, and the barrel.

11. The ball bat of claim 9 further comprising a layer of abrasion-resistant coating on an outer surface of the shrink-label.

12. The ball bat of claim 9 wherein the graphics comprise a sublimation ink.

13. The ball bat of claim 9 wherein the shrink-label comprises a shrink-sleeve.

* * * * *